US005733187A

United States Patent [19]

Bowe

[11] Patent Number: 5,733,187

[45] Date of Patent: Mar. 31, 1998

[54] PERSONNEL LIFT FOR USE IN SPRAY BOOTH SYTEMS

[75] Inventor: Gerald J. Bowe, Eau Claire, Wis.

[73] Assignee: JBI Incorporated, Osseo, Wis.

[21] Appl. No.: 624,181

[22] Filed: Mar. 29, 1996

[51] Int. Cl.[6] ..... B05B 15/12

[52] U.S. Cl. ..... 454/52; 118/326; 454/64

[58] Field of Search ..... 454/50, 51, 52, 454/63, 64; 118/326

[56] References Cited

U.S. PATENT DOCUMENTS

| | | | |
|---|---|---|---|
| 2,810,336 | 10/1957 | Sheffer et al. | 454/52 X |
| 4,926,746 | 5/1990 | Smith | 454/52 X |
| 5,505,387 | 4/1996 | Yaworski . | |

FOREIGN PATENT DOCUMENTS

| | | | |
|---|---|---|---|
| 568453 | 1/1959 | Canada | 118/326 |
| 143560 | 9/1980 | Germany | 118/326 |
| 6-91210 | 4/1994 | Japan | 118/326 |
| 975111 | 11/1982 | U.S.S.R. | 118/326 |
| 975112 | 11/1982 | U.S.S.R. | 118/326 |
| 1069873 | 1/1984 | U.S.S.R. | 118/326 |

*Primary Examiner*—Harold Joyce
*Attorney, Agent, or Firm*—Haugen and Nikolai, P.A.; Jonathan D. Spangler

[57] ABSTRACT

A personnel lift for use in spray booth systems having a partially enclosed work platform capable of X, Y, and Z axis mobility within the spray booth system and a flexible air supply conduit connecting the partially enclosed work platform to an air inlet manifold for supplying fresh air to the work platform.

21 Claims, 14 Drawing Sheets

PERSONNEL LIFT FOR USE IN SPRAY BOOTH SYTEMS

BACKGROUND OF THE INVENTION

I. Field of the Invention

The present invention relates generally to ventilated spray booth systems for enclosing spraying operations to confine and limit the escape of spray, vapor, and residue. More particularly, the present invention relates to an improved personnel lift for use in spray booth systems having a partially enclosed personnel basket capable of X, Y, and Z axis mobility within the spray booth system, and a flexible air supply conduit connecting the partially enclosed personnel basket to an air inlet plenum for supplying fresh air to the personnel basket.

II. Discussion of the Prior Art

The spray application of a surface coating to a work piece invariably generates a certain amount of contaminated air, including overspray, particulate, residue, and vapor. Such contaminated air is undesirable in that the overspray, particulate, and residue may settle on the work piece and form blemishes in the freshly applied paint, thereby detracting from the attractiveness and quality of the finish. Moreover, many surface coatings employed in spray applications are solvent based compounds which can produce vapors that have toxic effects on the environment if emitted into the atmosphere in overspray or vapor form, as well as explosive tendencies if contained within an enclosure. As a result, the primary considerations in designing spray booth systems include: (1) minimizing the degree to which contaminated air is emitted into the atmosphere to protect the environment; and (2) maintaining the vapor level within the spray booth to a minimum level to protect the workers disposed within the spray booth. To address these concerns, the Environmental Protection Agency (EPA) and the Occupational Safety and Health Administration (OSHA) have promulgated rigid guidelines to regulate spray booth technology.

Generally speaking, the EPA guidelines classify each type of surface coating and require the installation of appropriate control equipment within the spray booth corresponding to the particular surface coating classification. The most common classifications for surface coatings include Volatile Organic Compound (VOC) and Hazardous Air Pollutant (HAP). Due to the industrial nature of most spray booth applications, a surface coating designated as a VOC and/or a HAP will typically require Maximum Available Control Technology (MACT) to be installed in the spray booth, as opposed to the lesser requirement of installing Reasonably Available Control Technology (PACT). MACT control equipment is much more sophisticated and expensive than RACT control equipment and, therefore, the use of MACT control equipment translates into increased purchase, installation, and operating costs to meet the EPA guidelines.

Turning now to the OSHA standards, these regulations are designed generally to ensure the safety of the workers disposed within spray booths. One of the most important OSHA regulations requires that the concentration of the vapors and mists within the spray booth resulting from spray applications may not exceed 25 percent of the lower explosion limit (LEL). The LEL of a particular surface coating vapor is basically the threshold at which the vapor is subject to an increased likelihood of explosion. Therefore, to reduce the risk of explosion within spray booths, the OSHA regulations require that the concentration of the particular surface coating vapor or spray disposed within the spray booth must be diluted to a level 75 percent below the LEL. This, of course, requires further control equipment to accomplish the desired dilution of the surface coating vapor. Once again, such control equipment is typically very costly to purchase, install, and operate.

Various efforts have been undertaken through the years to produce control equipment which can condition contaminated air within spray booths for emission into the atmosphere and which can limit the concentration of the surface coating vapor within the spray booth so as to insure the safety of the workers within the spray booth. One such example is disclosed in U.S. Pat. No. 4,926,746 issued to Smith, wherein traditional down draft and side draft spray booth systems are provided with a confined stream of ventilating air which is designed to flow past the worker as the worker moves about within the interior of the spray booth. Recycling means are further provided in combination with the confined stream of ventilating air for diluting the concentration of the surface coating vapors below 25 percent of the LEL. With a reduced amount of fresh ventilating air entering the spray booth, a reduced amount of exhaust air will have to be removed to make room for the ventilating air. This reduction in the exhaust air exiting the spray booth reduces the costs associated with conditioning the contaminated exhaust air for eventual emission into the atmosphere.

However, several significant disadvantages exist with the system disclosed in the '746 patent. As an initial matter, while the system of the '746 patent may be effective in reducing some of the costs associated with conditioning the exhaust air, the capital costs associated with manufacturing and operating the system, on the whole, have proven to be monumental and, thus, prohibitive. In particular, a cumbersome articulated corridor is provided within the spray booth of the '746 patent for providing the confined stream of ventilating air to a worker within a cab member. The articulated corridor is constructed similar to that of a jet-way in an airport, comprising a plurality of rigid structures which are hollow and flexibly interconnected with a plurality of actuators so as to provide an internal walkway for the worker to pass from the outside of the spray booth to the cab member. The multitude of component parts required for the articulated corridor translates into overly high production and assembly costs. In addition to being overly costly to produce the articulated corridor assembly of the '746 patent, the tremendous size of the articulated corridor reduces the overall work space within the spray booth. This effectively reduces the number and size of the work pieces that may be disposed within the spray booth at a given time which, in turn, adversely affects productivity. Moreover, while the articulated corridor is technically capable of X, Y, and Z axis mobility, the bulky size of the articulated corridor reduces its ability to traverse in a quick and responsive manner within the spray booth. As such, the limited capacity to traverse quickly and smoothly within the spray booth effectively limits the productivity obtainable through the use of the spray booth system of the '746 patent.

Another substantial disadvantage of the '746 patent resides in the recirculation means employed to maintain the surface coating vapor level within the spray booth below 25 percent of the LEL. More particularly, the recirculation means involves the use of an increased number of fans to effectuate the recirculation of the contaminated air within the spray booth which, it will be appreciated, translates into increased operating costs in terms of the power consumption required to operate the recirculation fans. In this same regard, an increased number of filter assemblies are required to remove the overspray and particulate material from the contaminated air to prepare the contaminated air for recirculation. Moreover, the increased usage of filters will necessarily require an increased amount of time and money for service and replacement of the filters as they become overwhelmed with particulate material and residue from the recirculation operation. Finally, the multitude of fans, recirculation ducts, and filter assemblies makes it increasingly difficult, if not prohibitively difficult, to retro-fit a standard spray booth to produce the system of the '746 patent.

Even in the absence of recirculation means, a still further disadvantage exists with the system of the '746 patent relating to the number of articulated corridors which may be employed within the side draft embodiment of the '746 patent. More specifically, the side draft embodiment illustrated within the '746 patent is incapable of having an articulated corridor and movable cab member disposed along multiple side walls of the spray booth. To clarify, the cross draft of this embodiment requires a sideways flow of air from a first vertical wall to the opposite vertical wall within the spray booth. Due to this one-way flow of air, a first movable cab and articulated corridor can only be attached proximate the first vertical wall so that the spray applications performed by a worker disposed within the first movable cab will flow towards the work pieces as they pass along on the conveyor belt. If a second movable cab is disposed proximate the second vertical wall, the overspray from the first movable cab would drift toward and into the second movable cab, thereby causing potential problems with overspray accumulation on the second movable cab. Additionally, it will be appreciated that the use of such a conveyor belt effectively limits the size of the work pieces that are capable of being transferred there along. Therefore, the inability to place movable cabs along opposing vertical walls in a side draft configuration limits the number of spray applications which may be performed within the spray booth at a given time, as well as the size of the work pieces.

In light of the foregoing, therefore, a need exists for improved control equipment for conditioning the contaminated air within spray booths for emission into the atmosphere and for limiting the concentration of the surface coating vapor within the spray booth so as to insure for the safety of the workers within the spray booth, wherein the improved control equipment includes and an improved personnel lift of inexpensive design, requiring few component parts, and having minimal capital costs associated with manufacturing, assembly, and operation. A further need exists for an improved personnel lift having the ability to traverse in a quick and responsive manner within the spray booth so as to maximize productivity and efficiency. Yet another need exists for an improved personnel lift which is small in construction so as to maximize the amount of space within the spray booth for receiving work pieces. Still another need exists for an improved personnel lift which requires a minimal number of fan assemblies to pressurize the interior of the spray booth so that the power consumption, installation, and maintenance costs are reduced. A need also exists for a plurality of improved personnel lifts disposed along opposing vertical walls in a side draft configuration so as to increase the number of spray applications which may be performed within the spray booth at a given time, as well as housing work pieces of increased size within the spray booth.

OBJECTS AND SUMMARY OF THE INVENTION

Accordingly, it is a primary object of the present invention to provide improved control equipment for conditioning contaminated air within spray booths for emission into the atmosphere and for limiting the concentration of the surface coating vapor within the spray booth so as to better insure the safety of the workers within the spray booth, wherein the improved control equipment includes and an improved personnel lift of inexpensive design, requiring few component parts, and having minimal capital costs associated with manufacturing, assembly, and operation.

It is another object of the present invention to provide improved control equipment, including an improved personnel lift having the ability to traverse within the spray booth in a quick and responsive manner so as to maximize productivity and efficiency.

It is yet another object of the present invention to provide improved control equipment, including an improved personnel lift which is small in construction so as to maximize the amount of space within the spray booth for receiving work pieces.

It is another object of the present invention to provide improved control equipment, including an improved personnel lift that requires a minimal number of fan assemblies to pressurize the interior of the spray booth so that the power consumption, installation, and maintenance costs are reduced.

It is still another object of the present invention to provide an improved control equipment including a plurality of improved personnel lifts disposed along opposing vertical walls in a side draft configuration so as to increase the number of spray applications which may be performed within the spray booth at a given time, as well as housing work pieces of increased size within the spray booth.

In accordance with a broad aspect of the present invention, an improved personnel lift is provided for use in a spray booth having an intake plenum and an exhaust plenum. The improved personnel lift includes a personnel basket, a first frame member, a second frame member, an extension assembly, and a flexible air conduit. The personnel basket has an air inlet aperture and an air outlet aperture. The first frame member is disposed between the spray booth and the personnel basket for moving the personnel basket in a first plane. The second frame member is slidably attached to the first frame member for moving the personnel basket in a second plane. The extension assembly is interconnected between the second frame member and the personnel basket for moving the personnel basket in a third plane. The flexible air conduit has a first end disposed proximate the intake plenum and a second end attached to the air inlet aperture of the personnel basket for delivering fresh air from the intake plenum to the personnel basket.

In another broad aspect of the present invention, disclosed is a system for providing a supply of fresh air to a person working within a spray booth, wherein the spray booth includes a plurality of vertically disposed side walls and a ceiling member extending between the plurality of vertically disposed side walls. The system comprises an air intake plenum, an air exhaust plenum, and a personnel lift. The air intake plenum is disposed proximate the ceiling member of the spray booth, wherein the air intake plenum has at least one inlet aperture for directing air into the spray booth. The air exhaust plenum is disposed proximate a bottom portion of at least one of the plurality of vertically disposed side walls, wherein the air exhaust plenum has at least one outlet aperture for accepting air from the spray booth. The personnel lift is disposed within the spray booth and includes a partially enclosed personnel basket, a first frame member, a second frame member, extension means, a flexible conduit, and control means. The personnel basket has an air inlet aperture and an air outlet aperture. The first frame member is slidably attached to at least one of the plurality of vertically disposed side wails for moving the personnel basket in a first plane. The second time member is slidably attached to the first frame member for moving the personnel basket in a second plane. The extension means is interconnected between the second frame member and the personnel basket for moving the personnel basket in a third plane. The flexible conduit having a first end disposed proximate the at least one inlet aperture of the air intake plenum and a second end connected to the air inlet aperture of the personnel basket. The control means is disposed within the personnel basket for controlling the movement of the first frame member, the second frame member, and the extension means.

In yet another broad aspect of the present invention, disclosed is a method of retro-fitting a spray booth for providing a supply of fresh air to a worker within the spray booth, wherein the spray booth comprises a plurality of vertically disposed side wails and a ceiling member interconnected between a top portion of each of the plurality of side walls. The method comprises the steps of: (a) providing an air intake plenum proximate the ceiling member, wherein the air intake plenum includes at least one inlet aperture for directing air into the spray booth, louver means disposed within the at least one inlet aperture for selectively opening the at least one inlet aperture, and fan means for driving air through the at least one air inlet aperture; (b) providing an air exhaust plenum proximate a bottom portion of at least one of the plurality of side walls, wherein the air exhaust plenum includes at least one outlet aperture for accepting air from the spray booth, fan means for drawing air from within the spray booth through the at least one outlet aperture, louver means disposed within the air exhaust plenum for drawing air through a selected portion of the at least one outlet aperture, and filter means disposed proximate the at least one outlet aperture of the air exhaust plenum for filtering the air as the air is drawn into the at least one outlet aperture; and (c) providing a personnel lift within the spray booth, wherein the personnel lift includes a partially enclosed personnel basket having an air inlet aperture and an air outlet aperture, a first frame member slidably attached to at least one of the plurality of vertically disposed side walls for moving the personnel basket in a first plane, a second frame member slidably attached to the first frame member for moving the personnel basket in a second plane, extension means interconnected between the second frame member and the personnel basket for moving the personnel basket in a third plane, a flexible conduit having a first end disposed proximate the at least one inlet aperture of the air intake plenum and a second end connected to the air inlet aperture of the personnel basket, and control means disposed within the personnel basket for controlling the movement of the first frame member, the second frame member, and the extension means.

DETAILED DESCRIPTION OF THE PREFERRED EMBODIMENTS

Figure 1:
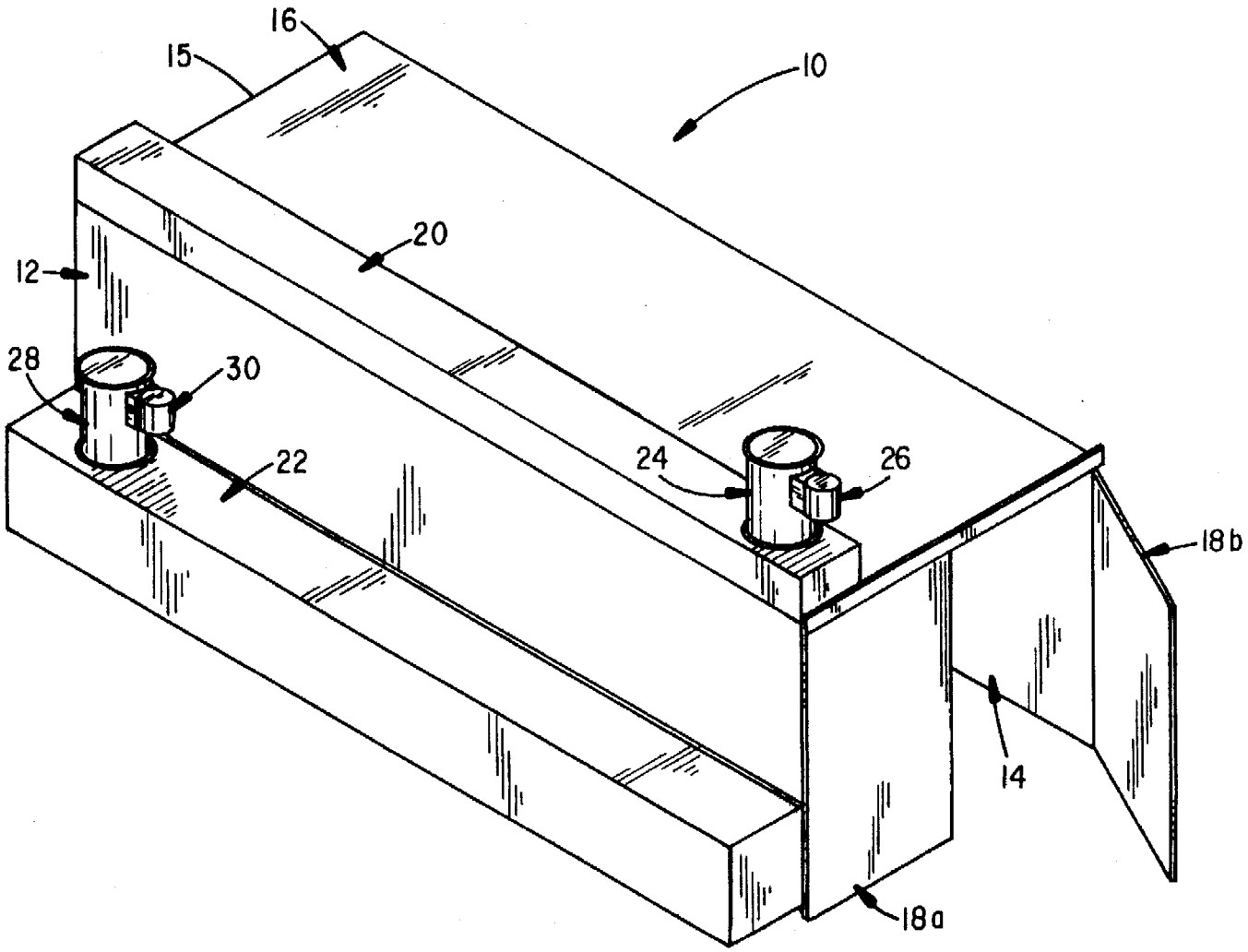
FIG. 1 is a perspective view of a spray booth equipped for use with an improved personnel lift of the present invention.

Referring initially to FIG. 1, shown in perspective is a spray booth 10 in accordance with a first preferred embodiment of the present invention. Spray booth 10 is generally rectangular in shape and includes a first side wall 12 disposed opposite and parallel to a second side wall 14. First and second door members 18*a*, 18*b* are hinged to first and second side walls 12, 14, respectively, and disposed opposite a first end wall 15. A ceiling member 16 overlays the mutually perpendicular side and end walls. An air intake plenum 20 is attached to ceiling member 16 of spray booth 10 along the junction between ceiling member 16 and first side wall 12. An air exhaust plenum 22 is further provided attached to first side wall 12 of spray booth 10 along the bottom portion thereof. As will be discussed in greater detail below, air intake plenum 20 and air exhaust plenum 22 are generally hollow structures disposed in fluid communication with the interior of spray booth 10. An intake stack 24 is provided in attachment with air intake plenum 20. Air intake stack 24 includes various temperature and humidity control elements for conditioning the flesh make-up air before entry into air intake plenum 20. An intake fan assembly 26 attached to intake stack 24 is provided for drawing fresh make-up air through intake stack 24 and for pressurizing the fresh make-up air within the interior of air intake plenum 20 for eventual injection into the interior of spray booth 10. In similar fashion, an exhaust stack 28 having an exhaust fan assembly 30 is attached to air exhaust plenum 22. Exhaust fan assembly 30 serves to draw the contaminated, overspray laden air from within spray booth 10 into air exhaust plenum 22. Exhaust stack 28 is further provided with various internally disposed cleaning elements for conditioning and detoxifying the contaminated air for eventual release into the atmosphere.

Figure 2:
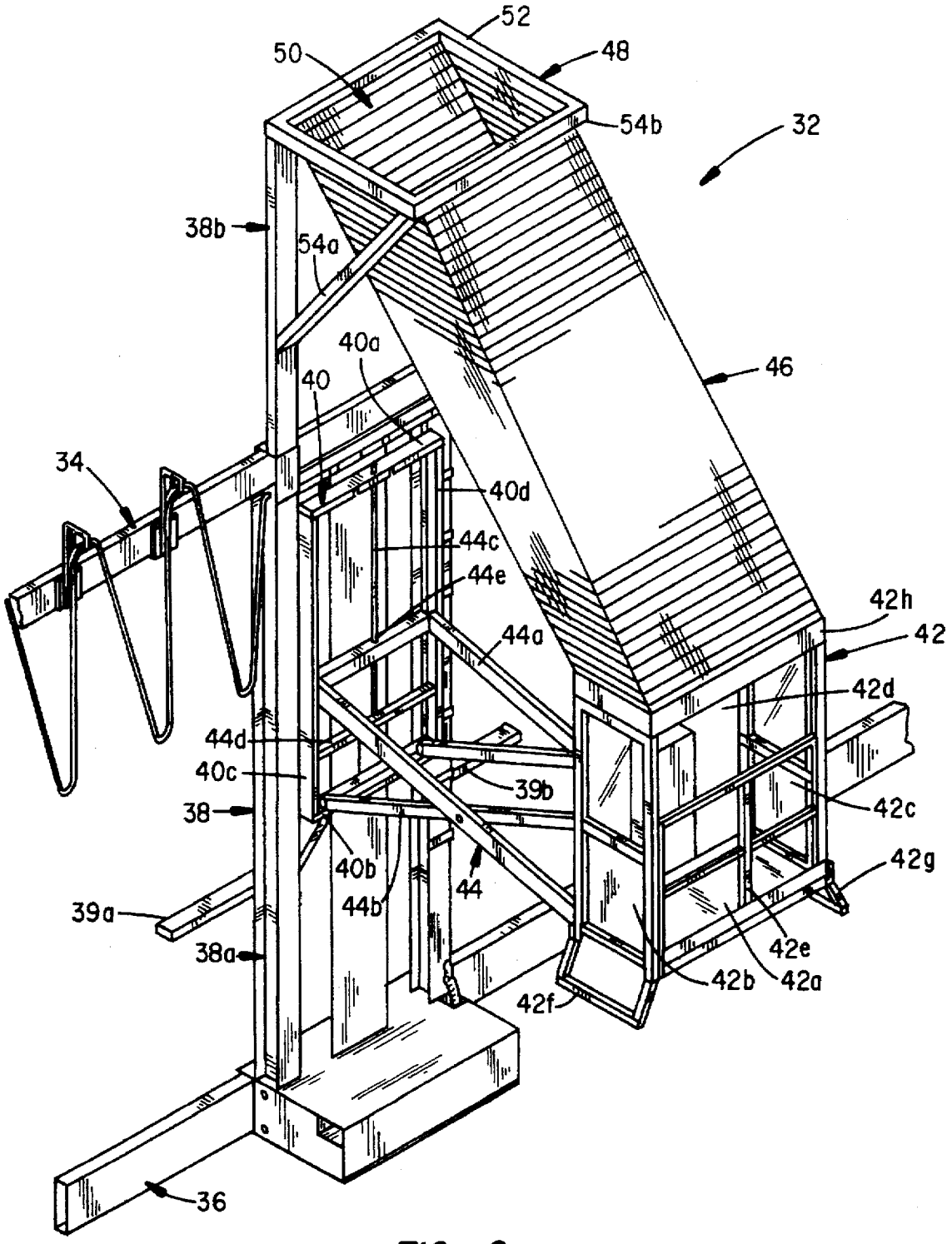
FIG. 2 is a perspective view of an improved personnel lift in accordance with a first preferred embodiment of the present invention.

With further reference to FIG. 2, shown is an improved personnel lift 32 for use within spray booth 10. By way of example and not limitation, personnel lift 32 is attached to the interior of spray booth 10 along first side wall 12 via an upper rail member 34 and a lower rail member 36. Personnel lift 32 includes a first frame member 38, a second frame member 40, a partially enclosed personnel basket 42, an extension assembly 44, and a flexible conduit 46. First frame member 38 includes a lower portion **38*a* and an upper portion 38*b*. Lower portion 38*a* includes a pair of laterally spaced girder members extending vertically between lower rail member 36 and upper rail member 34. A first rub bar 39*a* and a second rub bar 39*b* are provided attached to lower portion 38*a* for opening selected portions of air exhaust plenum 22 when personnel lift 32 traverses laterally back and forth within spray booth 10 along upper and lower rail members 34, 36. As will be described in greater detail below, first and second rub bars 39*a*, 39*b* extend laterally away from each respective girder member of lower portion 38*a* such that the contaminated air resulting from spray applications flows to either side of personnel lift 32 when exhaust fan assembly 30 draws the contaminated air into air exhaust plenum 22. Upper portion 38*b* comprises a pair of laterally spaced beam members extending vertically from lower portion 38*a* toward a conduit support frame 48. Conduit support frame 48 comprises a generally rectangular frame member 52 defining an air inlet aperture 50 therebetween. As will be discussed in further detail below, frame member 52 extends in a generally perpendicular fashion from the beam members of upper portion 38*b* such that air inlet aperture 50 is generally parallel to a corresponding air inlet aperture (not shown) of air intake plenum 20. A first brace member 54*a* and a second brace member 54*b* extend angularly between the beam members of upper portion 38*b* and an outer edge of frame member 52 to bolster the structural integrity of conduit support frame 48. In an important aspect of the present invention, first frame member 38 is slidably engaged to upper and lower rail members 34, 36 so as to allow personnel basket 42 to traverse laterally back and forth within spray booth 10**.

Second frame member 40 includes an upper cross bar **40*a*, a lower cross bar 40*b*, a first side bar 40*c*, and a second side bar 40*d*. Upper cross bar 40*a* has a first end attached to an upper end of first side bar 40*c* and a second end attached to an upper end of second side bar 40*d*. In like fashion, lower cross bar 40*b* has a first end attached to a lower end of first side bar 40*c* and a second end attached to a lower end of second side bar 40*d*. Arranged as such, upper and lower cross bars 40*a*, 40*b* are generally parallel to upper and lower rail members 34, 36, while first and second side bars 40*c*, 40*d* are generally parallel to the girder members of lower portion 38*a*. In an important aspect of the present invention, second frame member 40 is slidably engaged to first frame member 38 so as to allow personnel basket 42 to traverse vertically upward and downward within spray booth 10**.

Extension assembly 44 includes a first scissor arm **44*a* hingedly attached to a second scissor arm 44*b*, wherein first and second scissor arms 44*a*, 44*b* extend between personnel basket 42 and second frame member 40. More particularly, first scissor arm 44*a* has a first end slidably disposed within grooves formed along within the inner surfaces of first and second side bars 40*c*, 40*d* and a second end hingedly attached to a bottom portion of personnel basket 42. Conversely, second scissor arm 44*b* has a first end hingedly attached to first and second side bars 40*c*, 40*d* and a second end slidably disposed within grooves formed in a pair of side bars (not shown) disposed along the back portion of personnel basket 42. A cross bar 44*d* is disposed horizontally between first and second side bars 40*c*, 40*d* proximate lower cross bar 40*b*. A vertically disposed ball screw 44*c* is further provided having a first end rotatably coupled within an aperture formed in upper cross bar 40*a* and a second end rotatably coupled within an aperture formed within cross bar 44*d*. In addition to being rotatably coupled to upper cross bar 40*a* and cross bar 44*d*, ball screw 44*d* also passes through a pitched aperture 44*e* formed within the portion of first scissor arm 44*a* which extends horizontally between first and second side bars 40*c*, 40*d*. Actuation means (not shown) are provided proximate cross bar 44*d* for selectively rotating ball screw 44*c* in either a clockwise or counter clockwise fashion between upper cross bar 40*a* and cross bar 44*d*. Ball screw 44*c* has a spirally threaded engagement surface which engages with pitched aperture 44*e* formed within first scissor arm 44*a*. The clockwise rotation of ball screw 44*c* causes the first end of first scissor arm 44*a* to travel downward along the length of ball screw 44*c* toward cross bar 44*d*, while the second end of second scissor arm 44*b* simultaneously travels downward within the side bars (not shown) disposed on the back side of personnel basket 42 toward the bottom portion thereof. In other words, the first end of first scissor arm 44*a* is drawn progressively closer to the first end of second scissor arm 44*b*, while the second end of first scissor arm 44*a* is drawn progressively closer to the second end of second scissor arm 44*b*. This action, it will be appreciated, causes personnel basket 42 to move outwardly away from first side wall 12 within spray booth 10. In similar fashion, the counter clockwise rotation of ball screw 44*c* within pitched aperture 44*e* causes the first end of first scissor arm 44*a* to move progressively away from the first end of second scissor arm 44*b* while simultaneously moving the second end of first scissor arm 44*a* away from the second end of second scissor arm 44*b*. This action effectively draws personnel basket 42 inwardly toward first side wall 12 within spray booth 10**.

As can be seen, personnel basket 42 is partially enclosed and generally rectangular in shape. A floor member **42*a* extends horizontally along a bottom portion of personnel basket 42 for supporting any workers disposed therein. A first door member 42*b* and a second door member 42*c* extend vertically between floor member 42*a* and a hood member 42*h* and horizontally between a back wall 42*d* and a grate member 42*e*. First and second door members 42*b*, 42*c* are hingedly attached to back wall 42*d* to facilitate the entry and exit of workers into and out of personnel basket 42. In the embodiment shown, first and second door members 42*b*, 42*c* are further equipped with windows along the upper portions thereof to provide an improved view of the interior of spray booth 10 for any workers disposed within personnel basket 42. Hood member 42***h* extends along the upper portion of personnel basket 42 and, as will be described in greater detail below, contains an air inlet aperture (not shown) for directing a flow of fresh makeup air past any workers disposed within personnel basket 42. Grate member 42*e* extends laterally between first and second door members 42*b*, 42*c* opposite back wall 42*d* to provide a safety restraint for any workers disposed within personnel basket 42. First and second foot bars 42*f*, 42*g* are further provided to facilitate the entry and exit of workers into and from the interior of personnel basket 42.

In an important aspect of the present invention, personnel basket 42 has an air outlet aperture which extends vertically between the lower edge of hood member 42*h* and floor member 42*a* and horizontally between first and second door members 42*b*, 42*c* along a from face of personnel basket 42. This air outlet aperture allows the supply of fresh make-up which flows over the workers disposed within personnel basket 42 to exit from within personnel basket 42. Thus, the combination of the air inlet aperture (not shown) formed within hood member 42*h* and the air outlet aperture formed along the front face of personnel basket 42 allows a fresh supply of makeup air to flow over and past any workers disposed within personnel basket 42. This advantageously allows such workers to perform spraying activities while standing within personnel basket 42 without the need for oxygen masks and related equipment in that the workers are immersed in the outwardly flowing fresh make-up air and free from contact with any overspray, residue, and related fumes from the spray activity.

The transfer of fresh make-up air to personnel basket 42 is accomplished through the use of flexible conduit 46. Flexible conduit 46 has an upper end connected to conduit support frame 52 of first frame member 38 and a lower end connected to hood member 42*h*. It will be appreciated that flexible conduit 46 is hollow in construction so as to confine fresh make-up air that is forced from within air intake plenum 20 via intake fan assembly 26 for eventual distribution to hood member 42*h* of personnel basket 42. Moreover, as will be further illustrated, flexible conduit 46 is accordion-like in nature and is capable of extending and retracting corresponding to the vertical (Z-axis) and extension (Y-axis) position of personnel basket 42 within spray booth 10.

Figure 3:
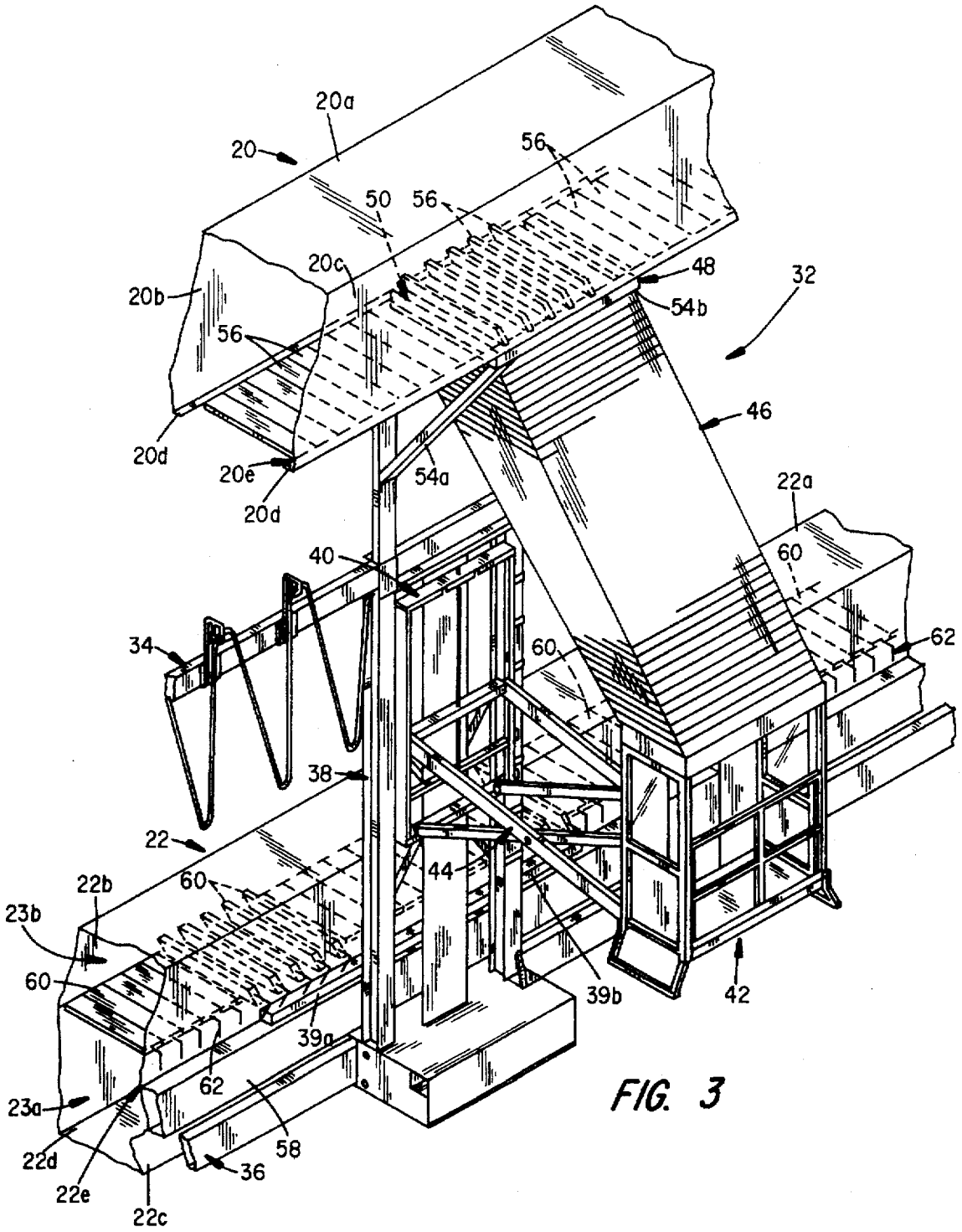
FIG. 3 is a perspective view of the improved personnel lift shown FIG. 2 in combination with an air inlet plenum and an air exhaust plenum, illustrating the opening of selected portions of the air inlet plenum and air exhaust plenum in accordance with the present invention.

With further reference to FIG. 3, shown is a perspective view illustrating the physical engagement between personnel lift 32, air intake plenum 20, and air exhaust plenum 22. While spray booth 10 is not shown in FIG. 3, it is to be understood with reference to FIG. 1 that air intake plenum 20 is attached to ceiling member 16 proximate first side wall 12 and air exhaust plenum 22 is attached to first side wall 12 along the bottom portion thereof. As noted above, air intake plenum 20 is hollow in nature and includes an upper wall portion 20*a*, a first side wall portion 20*b*, a second side wall portion 20*c*, and a lower wall portion 20*d*. Lower wall portion 20*d* has an elongated aperture 20*e* which extends approximately the entire length of air intake plenum 20 with a plurality of louver members 56 hingedly disposed therewithin. As will be described in greater detail below with reference to FIGS. 4A–4C, lower wall portion 20*d* of air intake plenum 20 is positioned in close vertical proximity to conduit support frame 48 such that conduit support frame 48 forces a selected number of louver members 56 into an open position as personnel lift 32 travels laterally within spray booth 10 along upper and lower rail members 34, 36. This, it will be appreciated, forces the pressurized make-up air within air intake plenum 20 to flow through air intake aperture 50 of conduit support frame 48 and into flexible conduit 46 for distribution into personnel basket 42.

Air exhaust plenum 22 is similarly provided with an upper wall portion 22*a*, a first side wall portion 22*b*, a second side wall portion 22*c*, and a bottom wall portion 22*d*. A plurality of louver members 60 are provided within air exhaust plenum 22 extending horizontally between first and second side wall portions 22*b*, 22*c*. More specifically, each louver member 60 is equipped with a pivot arm 62 extending horizontally therethrough for rotating each louver member 60 within air exhaust plenum 22. A lower chamber 23*a* of air exhaust plenum 22 extends vertically between bottom wall portion 22*d* and the plane defined by pivot arms 62, and horizontally between first and second side wall portions 22*b*, 22*c*. In similar fashion, an upper chamber 23*b* of air exhaust plenum 22 extends vertically between upper wall portion 22*a* and the plane defined by pivot arms 62, and horizontally between first and second side wall portions 22*b*, 22*c*. As will be described in greater detail with reference to FIGS. 5A–5C, each pivot arm 62 includes an L-shaped end which extends through second side wall portion 22*c* for engagement with first and second rub bars 39*a*, 39*b*. Moreover, louver members 60 are specifically weighted so as to be self-centering when there is no physical contact between pivot arms 62 and first and second rub bars 39*a*, 39*b*. In this situation, the upper surface of each louver member 60 will remain horizontally disposed within air exhaust plenum 22 such that no fluid communication exists between lower chamber 23*a* and upper chamber 23*b* of air exhaust plenum 22. Conversely, louver members 60 are forced into rotation when there is physical contact between the L-shaped ends of pivot arms 62 and first and second rub bars 39*a*, 39*b* so as to provide fluid communication between lower chamber 23*a* and upper chamber 23*b*. More specifically, the length of first rub bar 39*a* dictates the number of louver members 60 which will be rotated to open a fluid passageway between lower and upper chambers 23*a*, 23*b* along a first side of personnel life 32, while the length of second rub bar 39*b* dictates the number of louver member 60 which will be rotated to open a fluid passageway between lower and upper chambers 23*a*, 23*b* along a second side of personnel lift 32.

It is to be noted with particularity that exhaust fan assembly 30 is disposed in communication with upper chamber 23*b* so as to develop a suction or negative pressure therewithin. It is also to be noted that an elongated filter aperture 22*e* is formed within second side wall portion 22*e* which extends approximately the entire length of air exhaust plenum 22 and which has an elongated filter member 58 disposed therein. As such, the forced opening of a selected number of louver members 60 via first and second rub bars 39*a*, 39*b* causes contaminated, overspray laden air to be drawn into corresponding lengths along filter member 58. Filter member 58 serves to remove overspray and related particulate matter from the contaminated air as the contaminated air is draw into lower chamber 23*a* of air exhaust plenum 22. This arrangement thereby effectively eliminates the possibility of having overspray or residue accumulate on and/or between louver members 60 so as to ensure for the smooth and repeated operation of louver members 60 within air exhaust plenum 22. Moreover, the use of first and second rub bars 39*a*, 39*b* in combination with louver members 60 serves to localize the inward flow of contaminated air into air exhaust plenum 22 such that contaminated, overspray laden air produced from spray activities conducted from within personnel basket 42 are drawn immediately backward toward first side wall 12 of spray booth 10 on either side of personnel lift 32. In an important feature of the present invention, the localized flow of contaminated air into air exhaust plenum 22 on either side of personnel lift 32 provides what is referred to hereinafter as a reverse side draft. As will be explained in greater detail below with reference to FIGS. 7–10, the reverse side draft feature of the present invention allows a multitude of personnel lifts 32 to be disposed within a single spray booth 10, along one or more side walls, without overspray drifting between the spray application performed from within each personnel lift 32.

Figure 4A:
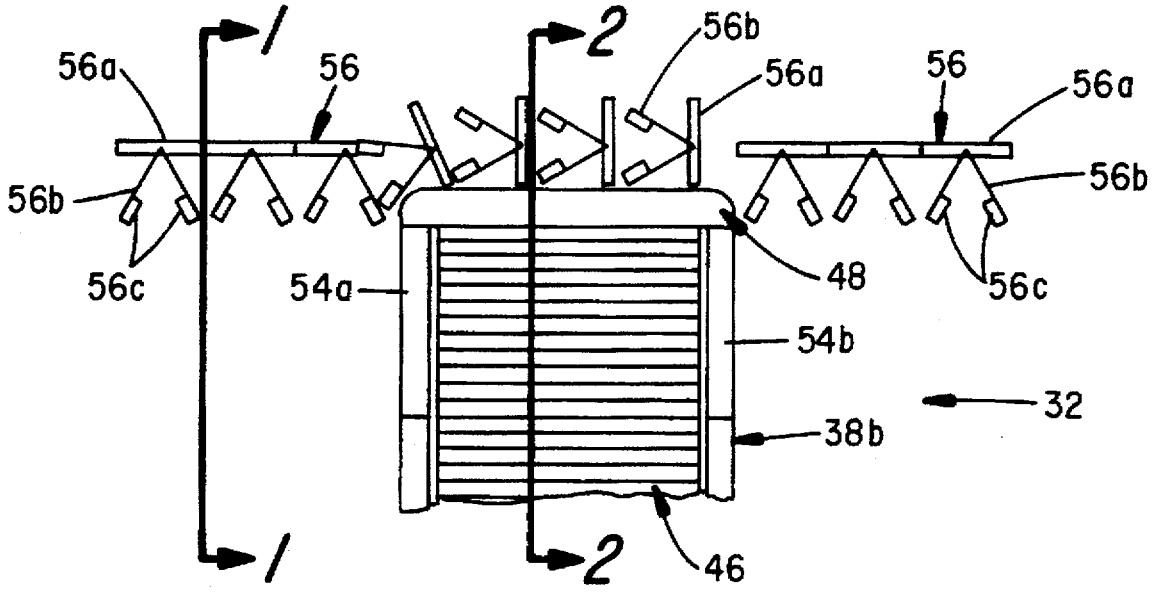
FIG. 4A is a front view of the engagement between the improved personnel lift of the present invention and the air intake plenum.

Referring now to FIG. 4A, shown is a front elevational view depicting the engagement between personnel lift 32 and louver members 56 of air intake plenum 20. For the sake of clarity, the various wall portions of air intake plenum 20 are not shown so as to highlight the hinged operation of louver members 56 with personnel lift 32. As in the embodiment shown in FIGS. 2 and 3, upper portion **38*b* of first frame member 38 extends upward for connection to conduit support frame 48. First and second brace members 54*a*, 54*b* are disposed between the beam members of upper portion 38*b* and conduit support frame 48 to maintain conduit support frame 48 in a fixed and horizontal position in relation to upper portion 38*b*. Louver members 56 are self-centering in nature, wherein each louver member 56 includes a generally planar portion 56*a*, a V-shaped descending portion 56*b* extending from the lateral midline of planar portion 56*a*, and a pair of weighted portions 56*c* attached to the distal ends of descending portion 56*b*. Although air intake plenum 20 is not shown in FIG. 4A, it is to be understood with reference to FIG. 3 that the self centering nature of louver members 56 causes each planar portion 56*a* to be disposed in a coplanar relation within aperture 20*e* formed within bottom wall portion 20*d*. In so doing, the pressurized make-up air within air intake plenum 20 is maintained therewithin except for the specific portion where louver members 56 which are forced into rotation by conduit support frame 48. This forced rotation is accomplished positioning personnel lift 32 in relation to air intake plenum 20 such that conduit support frame 48 contacts descending portions 56*b* as personnel lift 32 travels laterally back and forth within spray booth 10**.

Figure 4C:
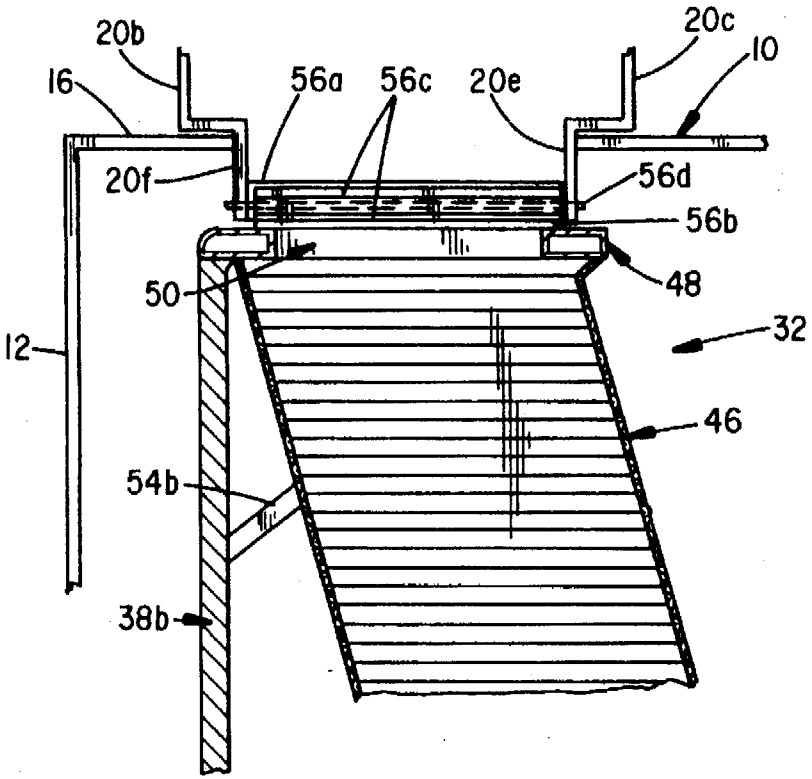
FIG. 4C is a partial sectional view of the engagement between the improved personnel lift of the present invention and the air intake plenum taken along lines 2—2 in FIG. 4A.
Figure 4B:
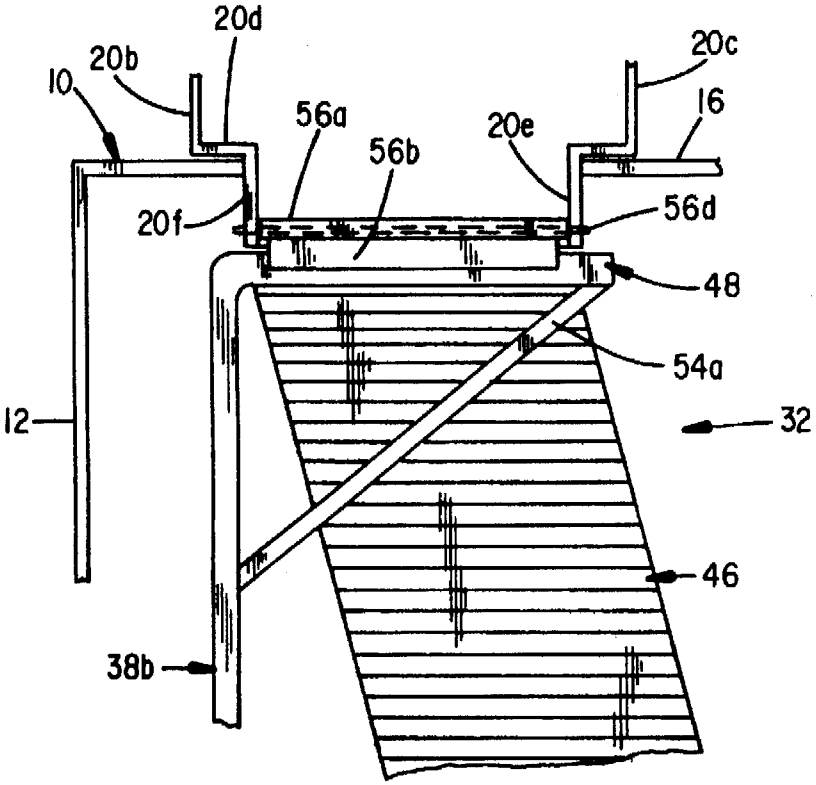
FIG. 4B is a partial sectional view of the engagement between the improved personnel lift of the present invention and the air intake plenum taken along lines 1—1 in FIG. 4A.

Referring now to FIGS. 4B and 4C, shown are partial sectional views taken along lines 1—1 and 2—2 of FIG. 4A, respectively, further illustrating the interaction between personnel lift 32 and air intake plenum 20. By way of illustration and not limitation, lower wall portion **20*d* of air intake plenum 20 is shown having an extension portion 20*f* extending vertically downward from air inlet aperture 20*e*. A rod member 56*d* is further provided extending through extension portion 20*f* and louver member 56 to illustrate one technique of hingedly fixing louver members 56 within air inlet aperture 20*e* of air intake plenum 20. With specific reference to FIG. 4B, shown is a single louver member 56 while in the closed position, wherein planar portion 56*a* resides in a horizontal position within air inlet aperture 20*e* of air intake plenum 20, while descending portion 56*b* extends vertically downward between the bottom surface of planar portion 56*a* and a point below the upper surface of conduit support frame 48. Arranged as such, conduit support frame 48 is positioned to strike descending portion 56*b* when personnel lift travels laterally back and forth within spray booth 10. This can be seen with specific reference to FIG. 4C, wherein a single louver member 56 is shown in the open position. During this condition, conduit support frame 48 strikes descending portion 56*b* such that the distal end of one side of descending portion 56*b* slides across the upper surface of conduit support frame 48. Planar portion 56*a* is thereby rotated into a substantially vertical position within air inlet aperture 20*e* which, in turn, opens up a fluid passageway between the interior of air intake plenum 20 and air intake aperture 50 of conduit support frame 48. Once again, the make-up air residing within air intake plenum 20 is pressurized through the use of intake fan assembly such that, when louver member 56 is in the open position, make-up air is forcibly driven into flexible conduit 46 for release into personnel basket 42**.

Figure 5A:
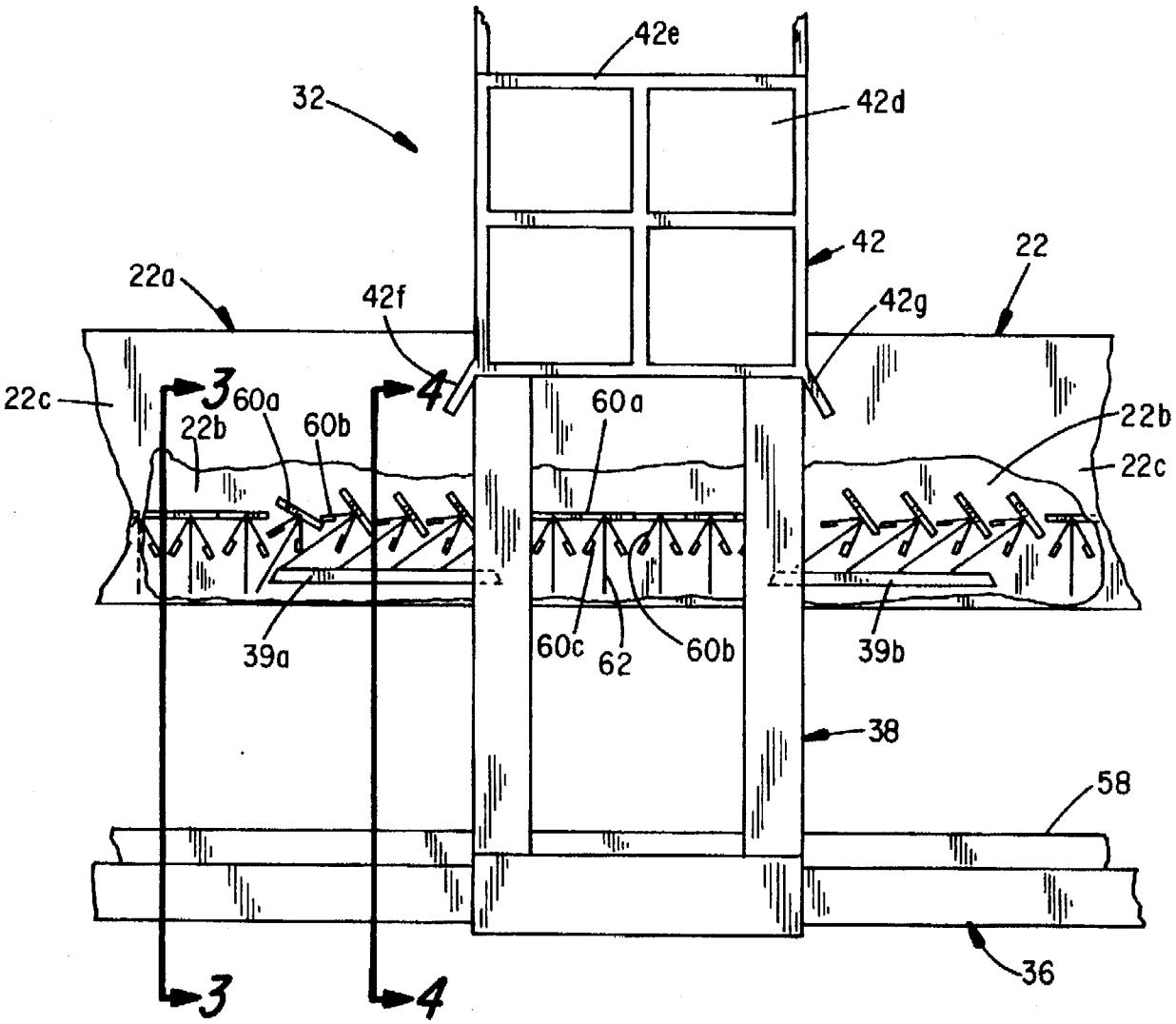
FIG. 5A is a front view of the engagement between the improved personnel lift of the present invention and the air exhaust plenum.
Figure 5B:
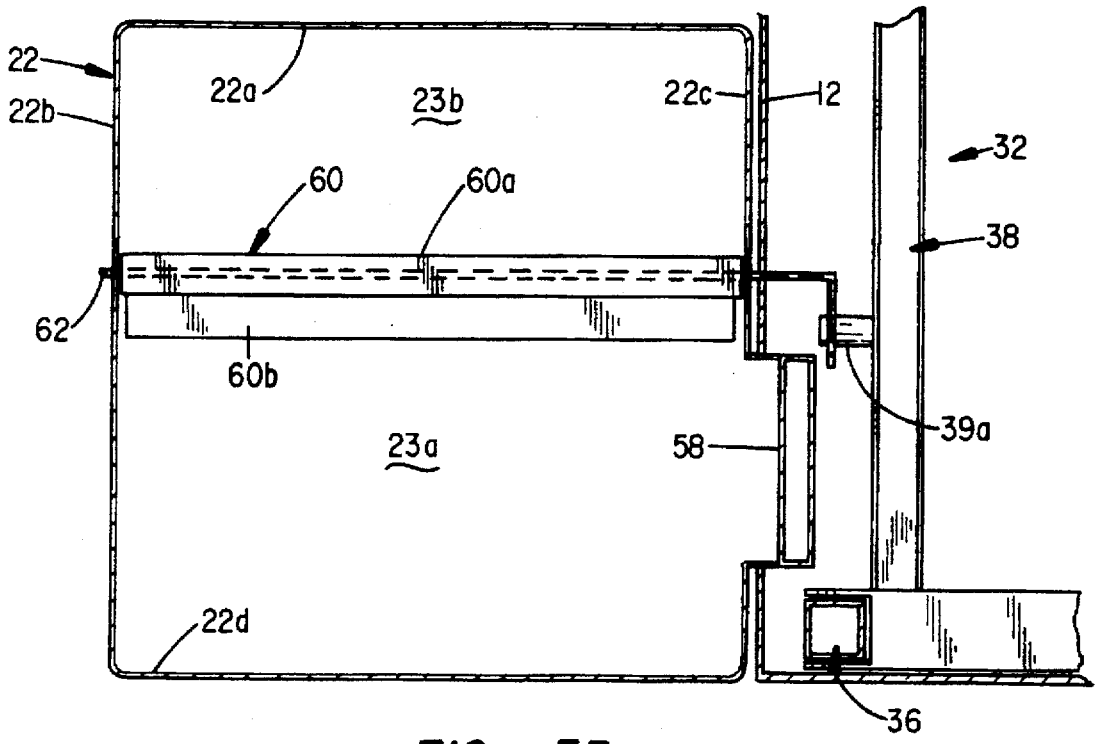
FIG. 5B is a partial sectional view of the engagement between the improved personnel lift of the present invention and the air exhaust plenum taken along lines 3—3 in FIG. 5A.
Figure 5C:
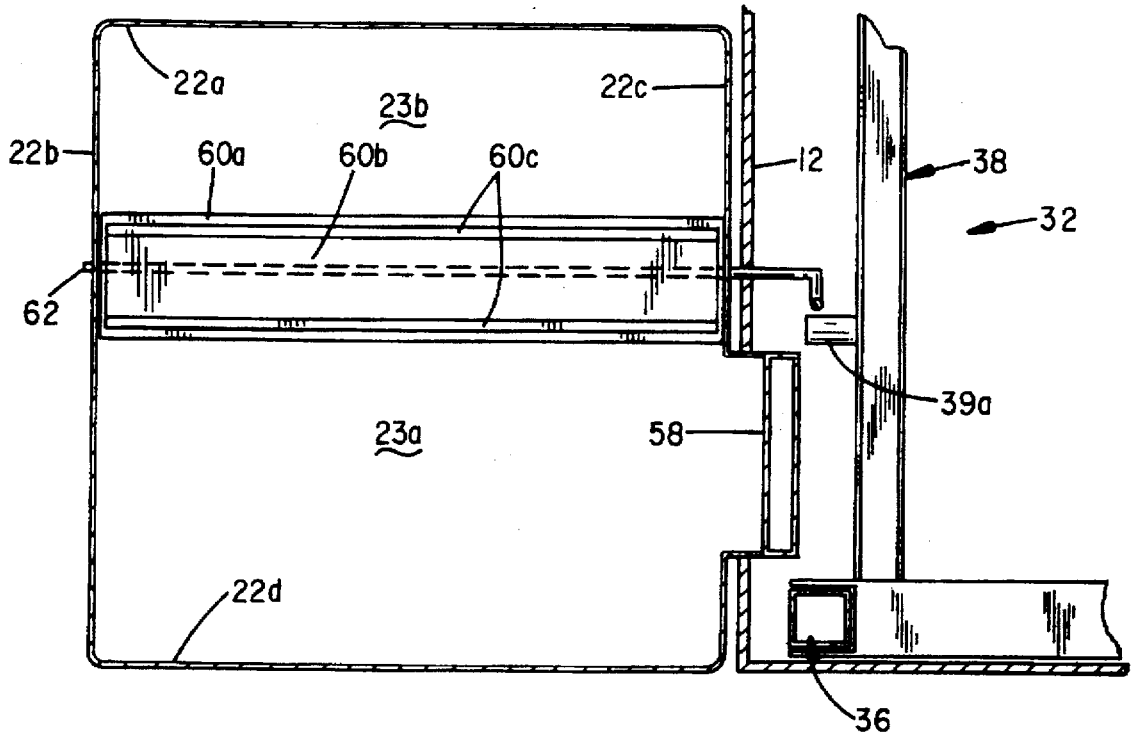
FIG. 5C is a partial sectional view of the engagement between the improved personnel lift of the present invention and the air exhaust plenum taken along lines 4—4 in FIG. 5A.

Referring now to FIGS. 5A–5C, depicted is the engagement between personnel lift 32 and air exhaust plenum 22. FIG. 5A illustrates a front view of personnel lift 32 of the present invention with personnel basket 42 in an elevated vertical position along first frame member 38. For the sake of clarity, second side wall portion **22*c* of air exhaust plenum 22 is shown in a partial cut-away view to illustrate the positioning of louver members 60 therewithin. As noted above, louver members 60 are self-centering, wherein each louver member 60 includes a generally planar portion 60*a*, a V-shaped descending portion 60*b* extending from the lateral midline of planar portion 60*a*, and a pair of weighted portions 60*c* attached to the distal ends of descending portion 60*b*. The self centering nature of louver members 60 causes each planar portion 60*a* to be disposed in a coplanar relation within air exhaust plenum 22 when no contact is made between first and second rub bars 39*a*, 39*b* and pivot arms 62. Conversely, louver members 60 are forced open when first and second rub bars 39*a*, 39*b* come move into contact with pivot arms 62 as personnel lift 32 travels laterally back and forth within spray booth 10. In this regard, FIG. 5B is a partial sectional view taken along lines 3—3 of FIG. 5A illustrating a single louver member 60 in the closed position, whereas FIG. 5C is a partial sectional view taken along lines 4—4 of FIG. 5A illustrating a single louver member 60 in the open position. Louver members 60 operate in the same self-centering manner as louver members 56 disposed within air intake plenum 20. As such, a detailed description of the hinged operation of louver members 60 is deemed duplicative in light of the description of louver members 56 offered with reference to FIGS. 4A–4C** and need not be repeated.

It is particularly important to note with reference to FIG. 5A that first and second rub bars **39*a*, 39*b* extend laterally outwardly away from the girder members of first frame portion 38. In this arrangement, the louver members 60 disposed in between the girder members of first frame portion 38 will remain in the closed position such that no contaminated, overspray laden air will be drawn within first frame member 38. This advantageously reduces the likelihood that any overspray will accumulate and dog the operation of personnel lift 32. Moreover, the use of first and second rub bars 39*a*, 39*b* creates a first and a second main fluid passageway extending between the upper chamber and the lower chamber of air exhaust plenum 22 along opposite sides of personnel lift 32. As noted above, this is an important feature of the present invention in that it causes the contaminated, overspray laden air to travel from the personnel basket 42 rearward toward air exhaust plenum 22. This reverse side draft allows a plurality of personnel lifts 32** in accordance with the present invention to be disposed within a single spray booth so that a plurality of spray applications can be simultaneously performed without having overspray drift from one spray application to another.

Figure 6B:
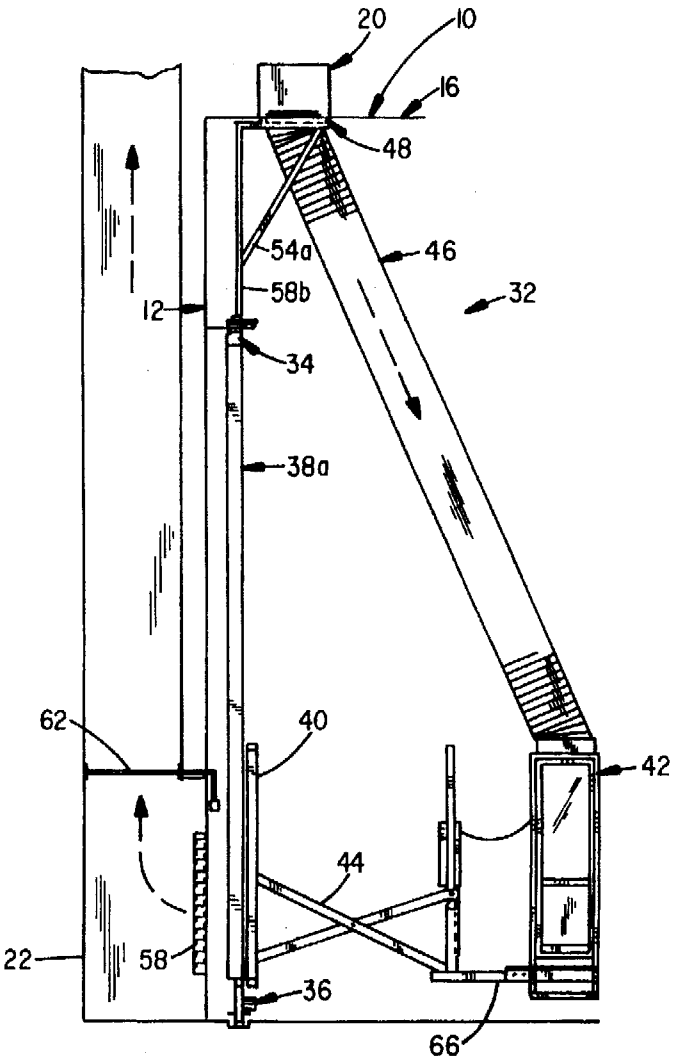
FIG. 6B is a side view illustrating the improved personnel lift of the present invention in a fully extended and lowered position within the spray booth.
Figure 6A:
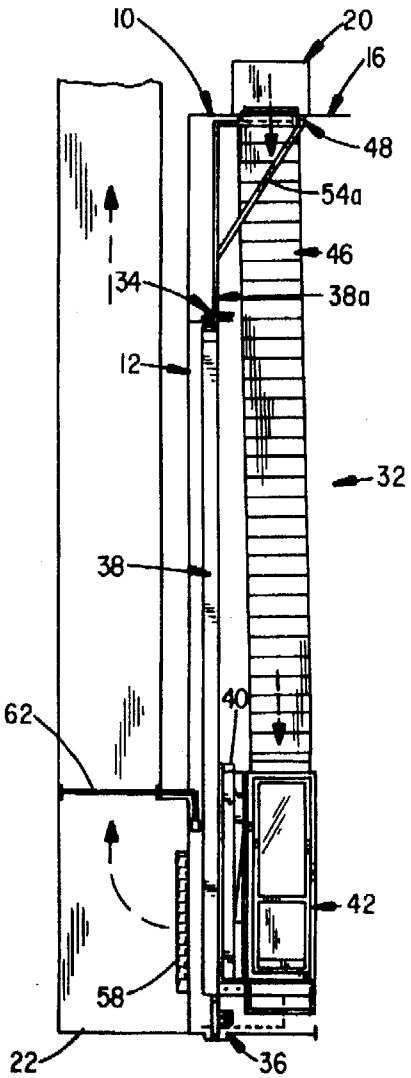
FIG. 6A is a side view illustrating the improved personnel lift of the present invention in a retracted and lowered position within the spray booth.
Figure 6C:
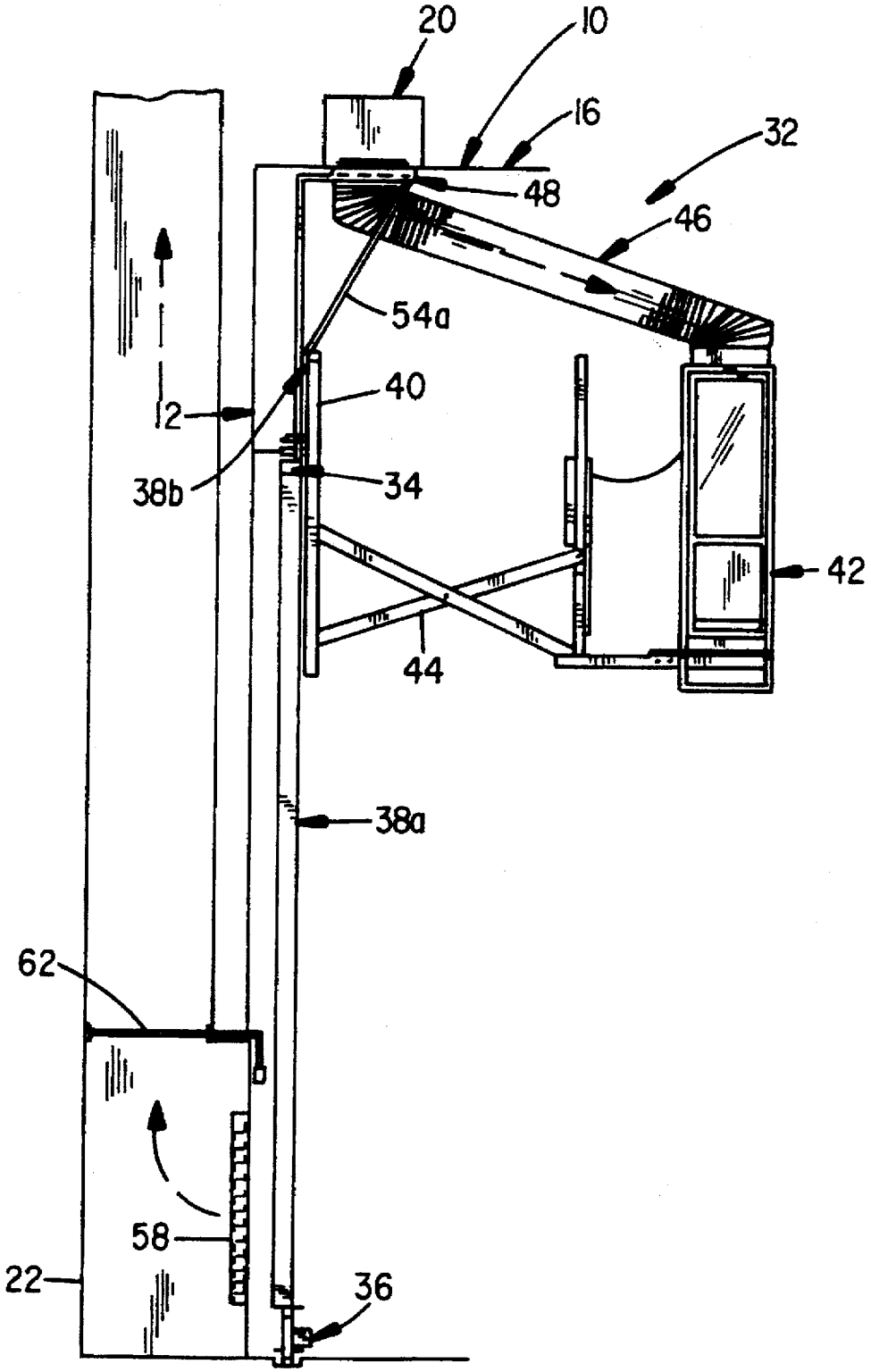
FIG. 6C a side view illustrating the improved personnel lift of the present invention in a fully extended and raised position within the spray booth.
Figure 6D:
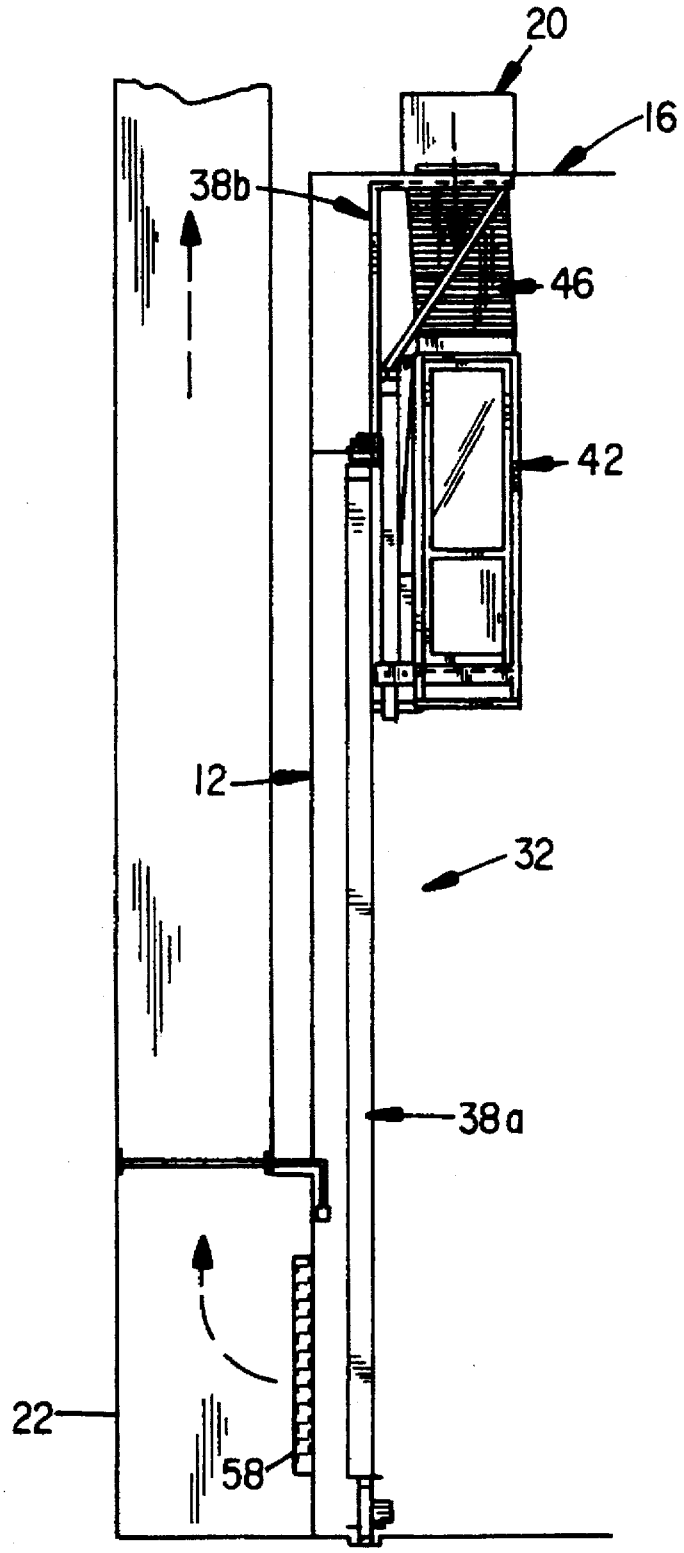
FIG. 6D a side view illustrating the improved personnel lift of the present invention in a retracted and raised position within the spray booth.

With reference now to FIGS. 6A–6D, a progression of side views is provided illustrating the full range of mobility that personnel lift 32 of the present invention boasts within spray booth 10. With initial reference to FIG. 6A, personnel lift 32 is provided with personnel basket 42 in a fully lowered and retracted position within spray booth 10. To be specific, second frame member 40 is lowered relative to first frame member 38 such that personnel basket 42 is disposed proximate the floor of spray booth 10 and extension assembly 44 is fully retracted to place personnel basket 42 proximate first side wall 12 of spray booth 10. FIG. 6B illustrates personnel basket 42 in a fully lowered and extended position within spray booth 10, wherein extension assembly 44 is fully extended to position personnel basket 42 within the interior of spray booth 10. A roll out assembly 66 is further provided to project personnel basket 42 an extra few feet within spray booth 10. In a typical application, extension assembly 44 will be capable of extending personnel basket 42 approximately 8 feet from second frame member 44, while roll out assembly 66 is capable of extending personnel basket 42 an extra 2 to 3 feet therepast for a total extension of between 10 and 11 feet from second frame member 40. FIG. 6C illustrates personnel basket 42 in a fully raised and extended position within spray booth 10. In this arrangement, second frame member 40 is positioned proximate the upper portion 38*b* of first frame member 38 while in the fully extended position described with reference to FIG. 6B. The maximum vertical height of personnel basket 42 may range greatly depending upon the particular specifications of spray booth 10. For example, in a typical application, the vertical travel of personnel basket 42 may range from 2 feet to 40 feet within spray booth 10. Lastly, FIG. 6D illustrates personnel basket in fully raised and retracted position within spray booth 10. With collective reference to FIGS. 6A–6D, it is important to note that flexible conduit 46 is capable of extending and retracting depending upon the position of personnel basket 42 such that a fresh supply of make-up air is constantly provided to personnel basket 42 irrespective of the position of personnel basket 42 within spray booth 10.

In light of the foregoing, it should be readily apparent that the improved personnel lift 32 of the present invention, in combination with air intake plenum 20 and air exhaust plenum 22, offers many significant advantages over the prior art. As an initial matter, the present invention is significantly less expensive than the systems found in the prior art in that personnel lift 32 is easy to manufacture and does not require overly complicated and cumbersome component parts to effectuate the delivery of a steady flow of fresh make-up air to workers disposed within personnel basket 42. This inexpensive design of the personnel lift 32, it will be appreciated, effectively minimizes the capital costs associated with manufacturing, assembly, and operation a spray booth 10 in accordance with the present invention.

Moreover, in that the present invention is substantially smaller and less cumbersome than the systems found in the prior art, the present invention is move response and can be manipulated quickly in all directions within spray booth 10. This, of course, translates into increased production capability. The reduced size of the present invention also provides the ability to maximize the amount of space within the spray booth for receiving work pieces, in addition to the ability to employ several personnel lifts 32 within the same spray booth. More specifically, due to the reverse side draft of the present invention, a plurality of personnel lifts 32 may be disposed along opposing vertical walls within the spray booth so as to increase the number of spray applications which may be performed within the spray booth at a given time, as well as housing work pieces of increased size within the spray booth. Once again, this advantageously translates into increased production capability.

Additionally, by providing air intake plenum 20 and air exhaust plenum 22 in combination with personnel lift 32, an existing spray booth 10 may be easily retro-fitted to produce an improved spray booth system in accordance with the present invention. Personnel lift 32, in combination with air intake plenum 20 and air exhaust plenum 22, also requires a minimal number of fan assemblies to pressurize the interior of the spray booth so that the power consumption, installation, and maintenance costs are reduced.

The various embodiments of the present invention have been described herein in considerable detail in order to comply with the Patent Statutes and to provide those skilled in the art with the information needed to apply the novel principles and to construct and use such specialized components as are required. It is to be understood that the invention can be carried out by specifically different means and that various modifications can be accomplished without departing from the scope of the invention itself.

Figure 7:
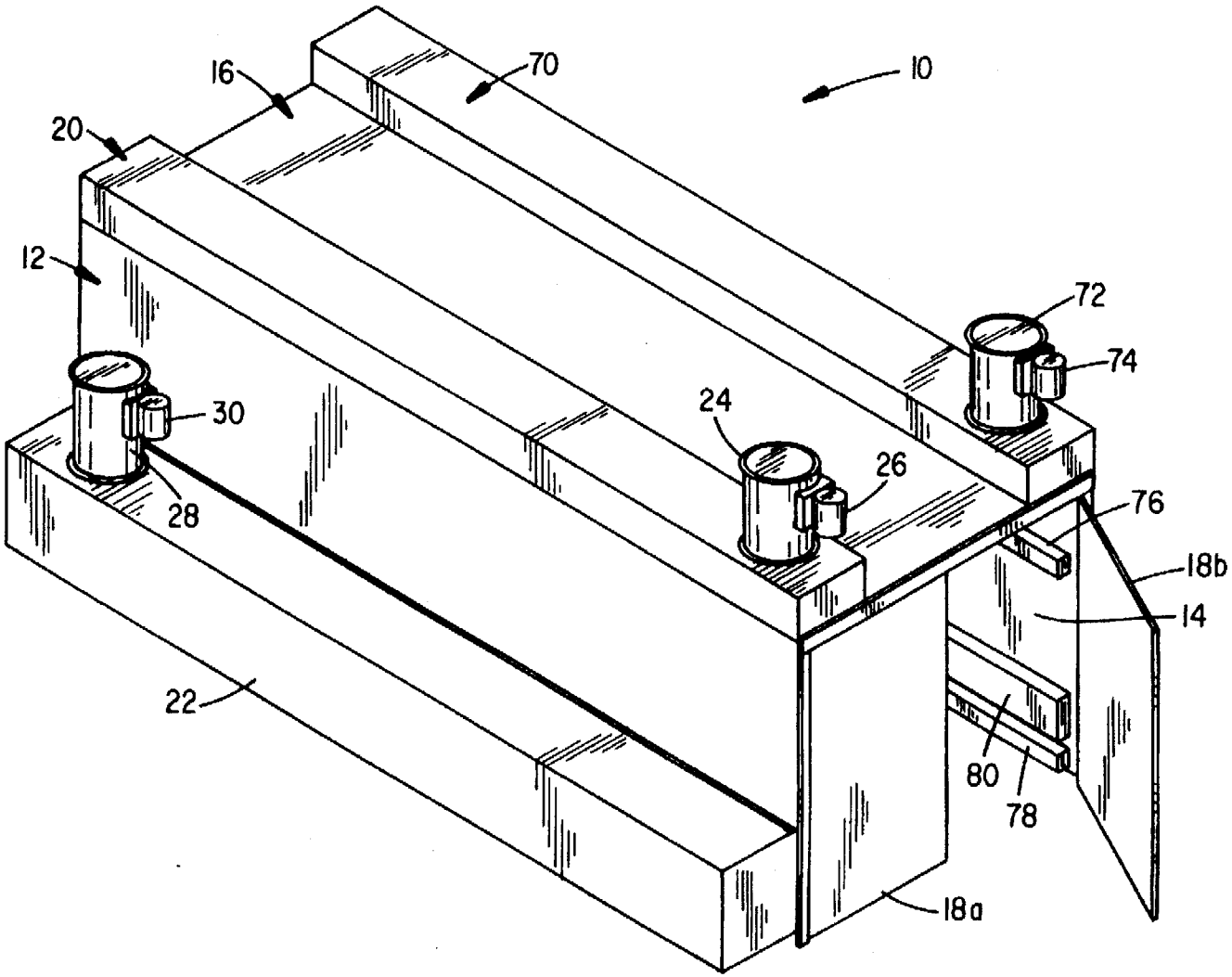
FIG. 7 is a perspective view of a spray booth equipped to employ at least one personnel lift of the present invention along each side wall.
Figure 8:
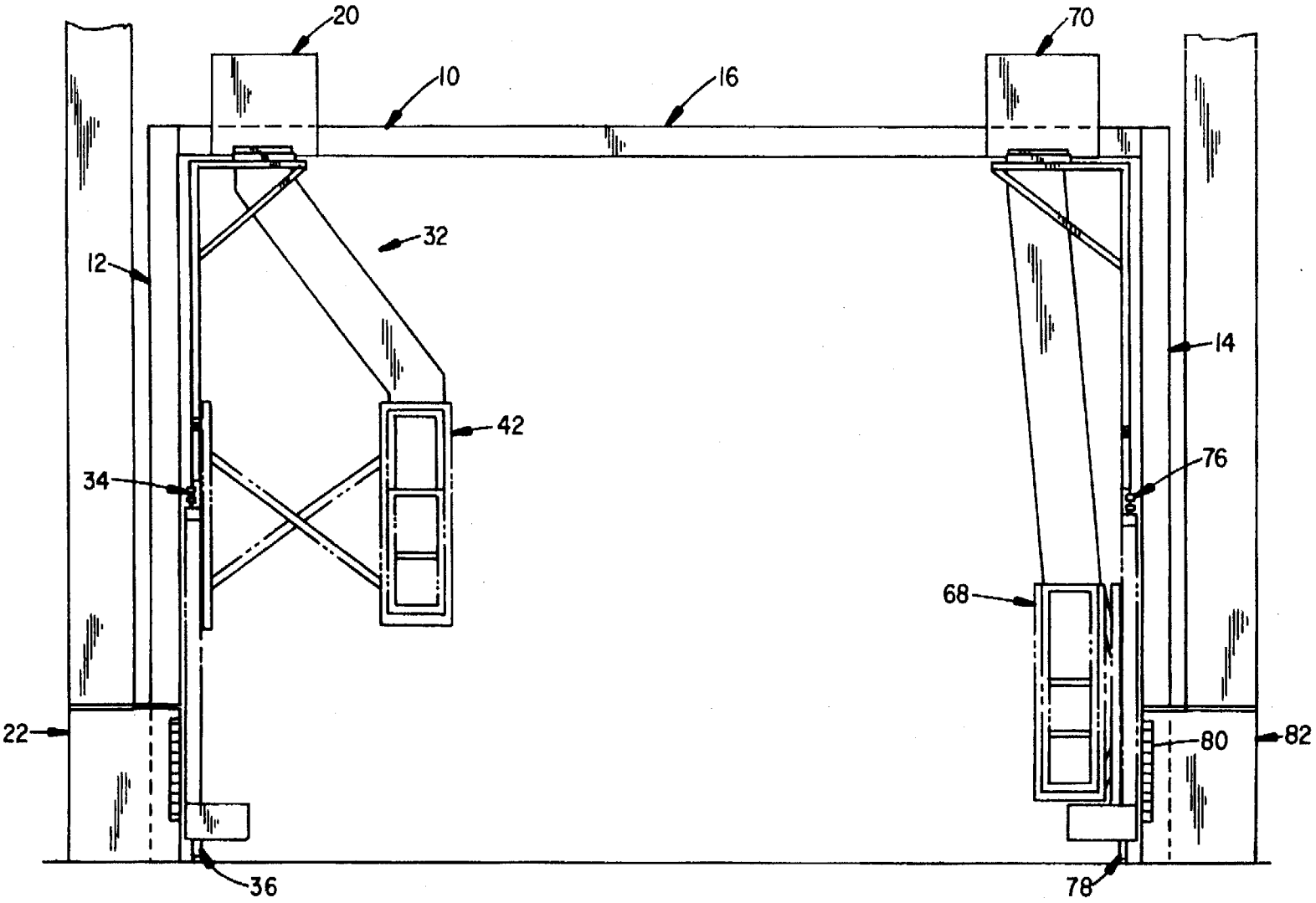
FIG. 8 is a side view illustrating the ability to simultaneously employ a plurality of personnel lifts in accordance with the present invention within the spray booth.

For example, referring to FIGS. 7 and 8, it is contemplated that spray booth 10 may be further equipped with a second air intake plenum 70 attached to ceiling member 16 proximate second side wall 14, and a corresponding second air exhaust plenum 82 disposed along the bottom portion of second side wall 14. Second air intake plenum 70 and second air exhaust plenum 82 are identical in construction to air intake plenum 20 and air exhaust plenum 22. In this regard, second air intake plenum 70 is equipped with an air intake stack 72 for conditioning the make-up air and an intake fan assembly 74 for pressurizing the interior of second intake plenum 70 with make-up air. An upper rail member 76 and a lower rail member 78 are provided horizontally along the interior of second side wall 14 for sliding engagement to a second personnel lift 68 in accordance with the present invention. Second air exhaust plenum 82 includes a filter member 80 which extends into the interior of spray booth 10 for removing overspray and particulate materials from the contaminated air as the contaminated air is drawn into second air exhaust plenum 82. Once again, such an arrangement is possible with the present invention due to the reduced size of personnel lifts 42 and 68, as well as the ability of the present invention to draw the overspray from each spray application rearward toward first and second side walls 12, 14, respectively. Additionally, it is fully contemplated to provide more than one personnel lift of the present invention along each side wall 12, 14. This, again, is due to the reduced size of the personnel lift and the ability to draw the overspray immediately rearward toward the respective wall that each personnel lift is attached.

Figure 9:
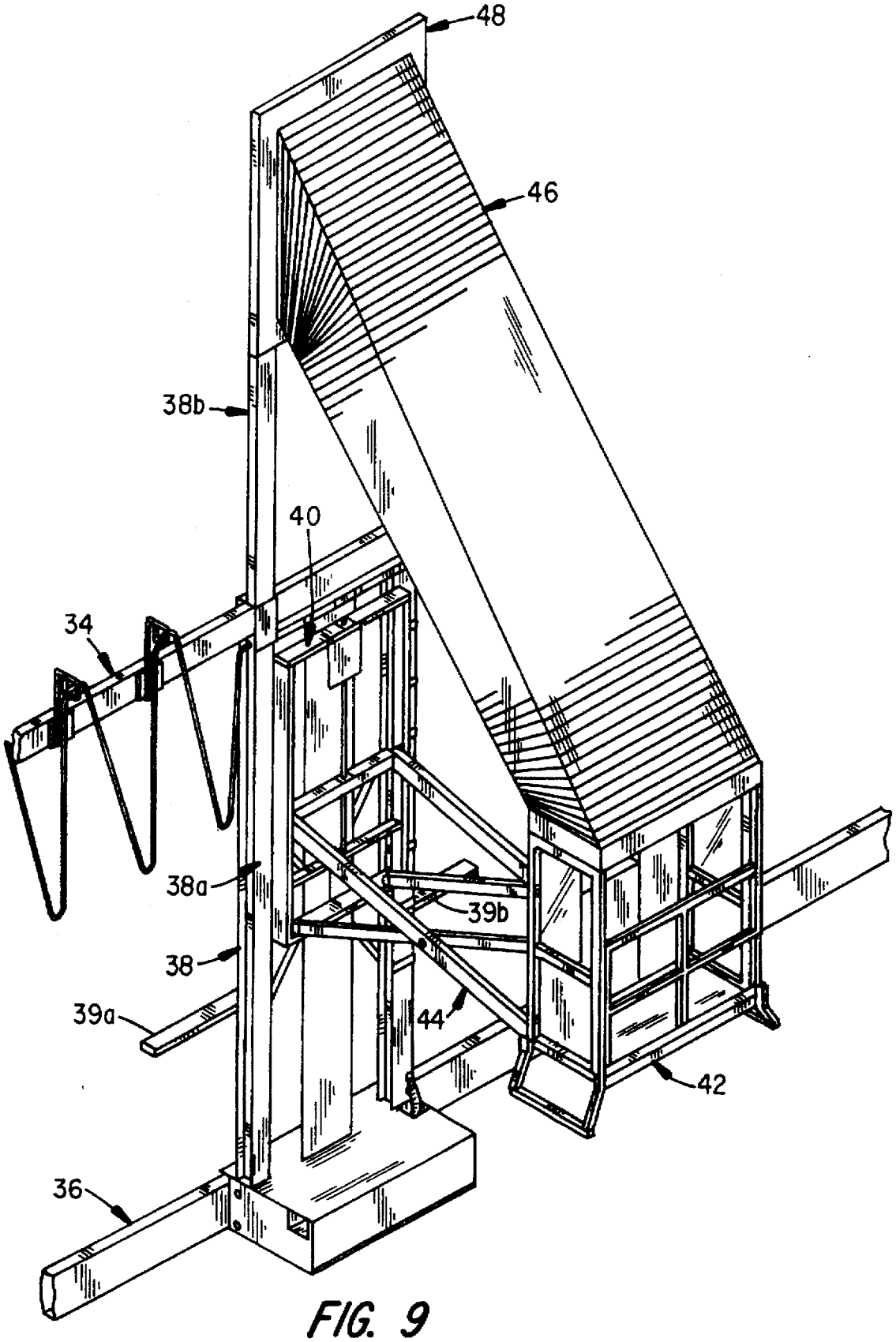
FIG. 9 is a perspective view of an improved personnel lift in accordance with a second preferred embodiment of the present invention.
Figure 10:
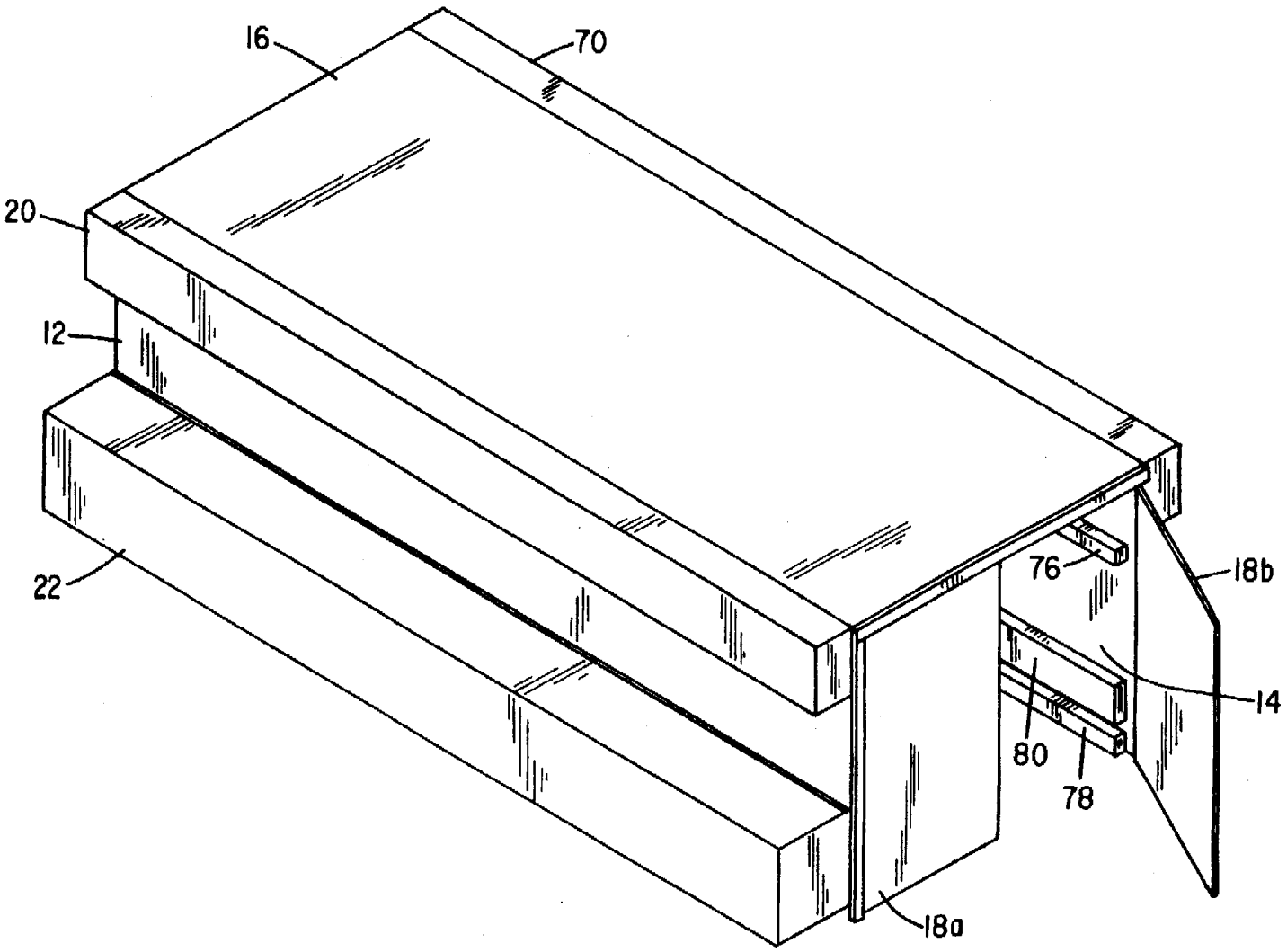
FIG. 10 is a perspective view of a spray booth equipped for use with the improved personnel lift of the present invention shown in FIG. 9.

With reference to FIG. 9, it is further contemplated to position conduit support frame 48 vertically with respect to upper portion 38*b* of first frame member 38. As shown with reference to FIG. 10, such an arrangement requires positioning air intake plenum 20 and second air intake plenum 70 in attachment to first and second side walls 12, 14, respectively, proximate ceiling member 16. Through the placement of air intake plenum 20 and second air intake plenum 70 along first and second side walls 12, 14 respectively, the overall height of spray booth 10 is minimized in that air intake plenum 20 and second air intake plenum 70 do not extend above ceiling member 16. This, in turn, allows the height of first and second side walls 12, 14 of spray booth 10 to be increased to make up for the removal of air intake plenum 20 and second air intake plenum 70 from ceiling member 16. In so doing, the embodiment shown in FIGS. 9 and 10 allows spray booth 10 to be designed having an internal capacity greater than the internal capacity of the spray booth 10 illustrated in FIGS. 1–7. An increased internal capacity within spray booth 10, of course, allows spray booth 10 to accommodate taller objects therewithin for spraying applications. As with the embodiment shown in FIGS. 7 and 8, it is to be readily understood that a multitude of personnel lifts 32 of the second embodiment shown in FIGS. 9 and 10 may be provided within spray booth 10 in conjunction with air intake plenum 20 and second air intake plenum 70 without departing from the scope of the present invention.

It is also to be understood that the window portions of first and second door members **42*b*, 42*c* may be selectively opened so as to allow spraying applications to be performed therethrough. In this same regard, it is contemplated that a scrolling closure assembly may be provided within hood member 42*h* for selectively closing the front surface of the personnel basket 42 to direct the flow of make-up air passing past the workers within personnel basket 42** and through the open window.

Moreover, while upper and lower rail members 34, 36 are employed in the particular embodiments illustrated in the drawings, it is to be understood that the various other means may be used to attach personnel lift 32 to the interior of spray booth 10 without departing from the scope of the present invention. For example, roller assemblies or other similar engagement means may be provided to facilitate the smooth lateral movement of personnel lift 32 within spray booth 10.

What is claimed is:

1. An improved personnel lift for use in a spray booth having an intake plenum and an exhaust plenum, comprising:

a personnel basket having an air inlet aperture and an air outlet aperture;

a first frame member disposed between said spray booth and said personnel basket for moving said personnel basket in a first plane;

a second frame member slidably attached to said first frame member for moving said personnel basket in a second plane;

an extension assembly interconnected between said second frame member and said personnel basket for moving said personnel basket in a third plane; and a flexible air conduit having a first end disposed proximate said intake plenum and a second end attached to said air inlet aperture of said personnel basket for delivering fresh air from said intake plenum to said personnel basket.

2. The improved personnel lift set forth in claim 1 and further, wherein said first frame member includes a lower frame portion and an upper frame portion, said lower portion being slidably engaged with said second frame member, said upper portion having a first end attached to said lower portion and a second end attached to a support frame, said support frame being connected to said first end of said air conduit.

3. The improved personnel lift set forth in claim 2 and further, wherein said extension assembly includes a first scissor arm hingedly attached to a second scissor arm, said first and second scissor arms having first ends hingedly attached to said second frame member and second ends hingedly attached to said personnel basket.

4. The improved personnel lift set forth in claim 3 and further, wherein said personnel basket includes a hood portion disposed proximate said air inlet aperture, said hood portion having directing means for directing the flow of air through said air inlet aperture.

5. The improved personnel lift set forth in claim 4 and further, wherein said directing means includes a plurality of manually operable louvers.

6. The improved personnel lift set forth in claim 5 and further, wherein said first frame member includes opening means for opening a portion of said exhaust plenum as said frame member moves within said first plane.

7. The improved personnel lift set forth in claim 6 and further, wherein said opening means includes at least one horizontally disposed rub bar.

8. The improved personnel lift set forth in claim 7 and further, wherein said support frame is disposed substantially perpendicular to said upper portion.

9. The improved personnel lift set forth in claim 7 and further, wherein said support frame is disposed in a substantially vertical fashion from said upper portion.

10. A system for providing a supply of fresh air to a person working within a spray booth, said spray booth including a plurality of vertically disposed side walls and a ceiling member extending between said plurality of vertically disposed side walls, comprising:

an air intake plenum disposed proximate said ceiling member of said spray booth, said air intake plenum having at least one inlet aperture for directing air into said spray booth;

an air exhaust plenum disposed proximate a bottom portion of at least one of said plurality of vertically disposed side walls, said air exhaust plenum having at least one outlet aperture for accepting air from said spray booth; and a personnel lift disposed within said spray booth, said personnel lift including a partially enclosed personnel basket having an air inlet aperture and an air outlet aperture, a first frame member slidably attached to said at least one of said plurality of vertically disposed side walls for moving said personnel basket in a first plane, a second frame member slidably attached to said first frame member for moving said personnel basket in a second plane, extension means interconnected between said second frame member and said personnel basket for moving said personnel basket in a third plane, a flexible conduit having a first end disposed proximate said at least one inlet aperture of said air intake plenum and a second end connected to said air inlet aperture of said personnel basket, and control means disposed within said personnel basket for controlling the movement of said first frame member, said second frame member, and said extension means.

11. The system set forth in claim 10 and further, wherein said first frame member includes a lower frame portion and an upper frame portion, said lower portion being slidably engaged with said second frame member, said upper portion having a first end attached to said lower portion and a second end attached to a support frame, said support frame being connected to said first end of said air conduit.

12. The system set forth in claim 11 and further, wherein said air intake plenum includes louver means disposed within said at least one inlet aperture for selectively opening said at least one inlet aperture, and fan means for driving air through said at least one air inlet aperture.

13. The system set forth in claim 12 and further, wherein said air exhaust plenum includes fan means for drawing air from within said spray booth through said at least one outlet aperture, louver means disposed within said air exhaust plenum for drawing air through a selected portion of said at least one outlet aperture, and filter means disposed proximate said at least one outlet aperture of said air exhaust plenum for filtering said air as said air is drawn into said at least one outlet aperture.

14. The system set forth in claim 13 and further, including control means for selectively activating said louver means of said air exhaust plenum, wherein said support frame is disposed substantially perpendicular to said upper portion of said first frame member.

15. The system set forth in claim 14 and further, wherein said extension assembly includes a first scissor arm hingedly attached to a second scissor arm, said first and second scissor arms having first ends hingedly attached to said second frame member and second ends hingedly attached to said personnel basket.

16. The system set forth in claim 15 and further, wherein said personnel basket includes a hood portion disposed proximate said air inlet aperture, said hood portion having directing means for directing the flow of air through said air inlet aperture.

17. The system set forth in claim 16 and further, wherein said directing means includes a plurality of manually operable louvers.

18. The system set forth in claim 17 and further, wherein said control means for selectively activating said louver means of said air exhaust plenum includes at least one horizontally disposed rub bar attached to said first frame member.

19. The system set forth in claim 18 and further wherein said support frame is disposed substantially perpendicular to said upper portion of said first frame member.

20. The system set forth in claim 18 and further wherein said support frame is disposed in a substantially vertical fashion from said upper portion of said first frame member.

21. A method of retro-fitting a spray booth for providing a supply of fresh air to a worker within said spray booth, said spray booth comprising a plurality of vertically disposed side walls and a ceiling member interconnected between a top portion of each of said plurality of side walls, comprising the steps of:

(a) providing an air intake plenum proximate said ceiling member, said air intake plenum including at least one inlet aperture for directing air into said spray booth, louver means disposed within said at least one inlet aperture for selectively opening said at least one inlet aperture, and fan means for driving air through said at least one air inlet aperture;

(b) providing an air exhaust plenum proximate a bottom portion of at least one of said plurality of side walls, said air exhaust plenum including at least one outlet aperture for accepting air from said spray booth, fan means for drawing air from within said spray booth through said at least one outlet aperture, louver means disposed within said air exhaust plenum for drawing air through a selected portion of said at least one outlet aperture, and filter means disposed proximate said at least one outlet aperture of said air exhaust plenum for filtering said air as said air is drawn into said at least one outlet aperture; and (c) providing a personnel lift within said spray booth, said personnel lift including a partially enclosed personnel basket having an air inlet aperture and an air outlet aperture, a first frame member slidably attached to said at least one of said plurality of vertically disposed side walls for moving said personnel basket in a first plane, a second frame member slidably attached to said first frame member for moving said personnel basket in a second plane, extension means interconnected between said second frame member and said personnel basket for moving said personnel basket in a third plane, a flexible conduit having a first end disposed proximate said at least one inlet aperture of said air intake plenum and a second end connected to said air inlet aperture of said personnel basket, and control means disposed within said personnel basket for controlling the movement of said first frame member, said second frame member, and said extension means.

* * * * *

UNITED STATES PATENT AND TRADEMARK OFFICE

CERTIFICATE OF CORRECTION

PATENT NO. : 5,733,187

DATED : March 31, 1998

INVENTOR(S) : Gerald J. Bowe

It is certified that error appears in the above-identified patent and that said Letters Patent is hereby corrected as shown below:

In column 1, line 51, please delete "(PACT)" and insert --(RACT)-- therefor.

In column 3, line 43, please delete the word "and".

In column 4, line 5, please delete the word "and".

In column 5, line 4, please delete the word "wails" and insert --walls-- therefor.

In column 5, line 5, please delete the word "time" and insert --frame-- therefor.

In column 5, line 21, please delete the word "wails" and insert --walls-- therefor.

In column 8, line 26, please delete "44d" (2nd occurrence) and insert --44c-- therefor.

In column 9, line 18, please delete the word "from" and insert --front-- therefor.

UNITED STATES PATENT AND TRADEMARK OFFICE

CERTIFICATE OF CORRECTION

PATENT NO. : 5,733,187

DATED : March 31, 1998

INVENTOR(S) : Gerald J. Bowe

It is certified that error appears in the above-identified patent and that said Letters Patent is hereby corrected as shown below:

In column 10, line 40, please delete the word "life" and insert --lift-- therefor.

In column 10, line 48, please delete "22e" (2nd occurrence) and insert --22c-- therefor.

In column 10, line 57, please delete the word "draw" and insert --drawn-- therefor.

In column 14, line 35, please delete the word "lift" and insert --basket-- therefor.

In column 14, line 42, please delete the word "lifts" and insert --baskets-- therefor.

Signed and Sealed this

Twenty-seventh Day of October, 1998

*Attest:*

Bruce Lehman

BRUCE LEHMAN

*Attesting Officer*

*Commissioner of Patents and Trademarks*